US005463402A

United States Patent [19]

Walrath et al.

[11] Patent Number: 5,463,402

[45] Date of Patent: Oct. 31, 1995

[54] MOTION MEASUREMENT SYSTEM AND METHOD FOR AIRBORNE PLATFORM

[75] Inventors: Craig D. Walrath, Catonsville; James V. Arnts, Severna Park, both of Md.

[73] Assignee: Thermo King Corporation, Minneapolis, Minn.

[21] Appl. No.: 40,241

[22] Filed: Mar. 30, 1993

[51] Int. Cl.[6] ..... H01Q 3/00

[52] U.S. Cl. ..... 342/359

[58] Field of Search ..... 342/359; 359/554; 89/41.09

[56] References Cited

U.S. PATENT DOCUMENTS 3,886,555 5/1975 Royal .

4,004,729 1/1977 Rawicz et al. ..... 235/61.5 S 5,050,087 9/1991 Walrath et al. .

*Primary Examiner*—Theodore M. Blum

[57] ABSTRACT

A motion measurement system having three angle rate sensors and three accelerometers mounted on a platform fixed relative to and movable with a rotary antenna. An azimuth bearing angle measurement, which is geographically corrected by external signals is generated to locate detected targets. An antenna scan rate measurement is generated to regulate antenna rotational speed. An along-beam velocity measurement is generated for use by the radar's ground clutter tracker to initialize its velocity set point.

10 Claims, 5 Drawing Sheets

MOTION MEASUREMENT SYSTEM AND METHOD FOR AIRBORNE PLATFORM

BACKGROUND OF THE INVENTION

1. Field of Invention

The present invention relates to motion measurement; and more particularly relates to a method and system for measuring motion of an airborne platform.

While the invention may be subject to several applications, it is especially suited for use in a surveillance system for a tethered aerostat, and will be particularly described in that connection.

2. Description of Related Art

A tethered aerostat, or aerodynamic balloon, has proven to be a reliable and cost effective platform for wide area surveillance using state-of-the-art sensors. Aerostats, such as that utilized by a low altitude surveillance system can support substantial payloads to in the neighborhood of 15,000 feet above sea level. These fixed site systems are strategically located and are tethered to supporting ground mooring systems via a power tether which provides on station mission capabilities in the neighborhood of two weeks, for example.

The moored aerostat wanders about a circle of uncertainty of up to 1.5 nm about the mooring system. Of course, the actual location of the aerostat is a function of speed and direction of the winds aloft.

Early aerostat systems were primarily for air surveillance within a defined air space; and included a single low altitude surveillance system, and thus accuracy requirements were only modest. Target bearing measurements could be satisfied with directional gyroscopes slaved to magnetic, or in other words, flux gate sensors, for north referencing. Ground control intercept was within the coordinate system of the singular surveillance system only; and thus absolute geographic reference was not critical, even though the aerostat carried payload could be displaced relative to the mooring point by as much as 1.5 nm, under high wind blow down conditions.

Previously, motion measurement systems used a flux gate referenced directional gyro to indicate aerostat pointing angle relative to north. Antenna pointing angle relative to the aerostat was then determined by adding the antenna angle relative to the aerostat space angle by passing the directional gyro synchro signal through a differential transformer mounted to the payload azimuth drive unit. In this configuration, the directional gyro was mounted to the aerostat super rack forward of the payload truss and radar pedestal. This created two error sources. The directional gyro was essentially mounted to the aerostat, and directly experienced any aerostat pitch and roll motion. Since a directional gyro is typically a two degree of freedom device, this induced predictable yaw measurement errors, called non-verticality or pendulous errors, and which are trigonometric functions of the pitch and roll components. For a possible aerostat pitch and roll of ±10°, yaw error could be as high as ±1.75° or 0.6°; root mean square (RMS), for example. Secondly, the super rack location introduced a flexible structure error component between the gyro and radar pedestal. Both of these errors are in evidence under turbulent conditions.

Subsequently, the directional gyro was located directly on the radar payload pedestal, on the gravity stabilized side of the viscous damped gimbal system, but not on the rotating payload platform. This configuration essentially eliminated the unknown flexure of the gyro-to-pedestal and the non-verticality error; and platform pitch and roll was reduced typically to less than ±1° which translates to a non-verticality error of ±0.017° or 0.006° RMS. This configuration, therefore, obviated the need for a three degree of freedom azimuth measuring device. Although payload sensor (radar and beacon) azimuth report accuracies have been measured at levels expected of similar ground based sensors, during times of aerostat motion, the scan to scan azimuth accuracies have been shown to be degraded by objectionable systematic error components. This was evidenced by several low frequency components and has been referred to by display operators as target stitching.

Error sources were speculated to be due to coupling of the magnetic flux gate into the gyro outputs as the aerostat was subjected to turbulent conditions. This was likely due to pendulous errors of the flux gate itself, as it was mounted in an unstabilized location on the aerostat, or due to non-compensation of the flux gate, and changes in local magnetic fields aboard the aerostat, as wind direction shifted. Attempts to calibrate the flux gate with techniques successfully used on aircraft installations were unsuccessful because of the large ferrous components of the aerostat mooring system nearby.

In many respects, an aerostat is a rather benign environment, as compared to a commercial or military aircraft for which inertial systems are designed. However, absolute north reference of a relatively stable system for as long as two weeks, for example, which is required for accurate surveillance, proved to be a problem.

A measurement system for determining continuously the actual latitude and longitude of targets requires an inertial navigation system, utilizing gyros, which are typically slaved to some north reference device for long term stability. Typically, the gyros align to north while in a non-moving ground environment. Then, of course, they must be updated along the flight path by external inputs, such as from a global positioning system (GPS) or Loran C for example. The gyros of an inertial navigation system may be either, the well known mechanical gyros or Ring Laser gyros, for example. However, such inertial navigation units are considered unacceptable for tethered aerostats for several reasons. The long term performance of north referencing beyond approximately eighteen hours cannot be assured. An inertial navigation system can not typically be realigned in-flight with the aerostat pitching and rolling.

Additionally, the netting of several low altitude surveillance radar systems and beacons mounted on multiple aerostats, and with corresponding multiple ground stations is required. The netting requirements impose a relative stringent geographically referenced azimuth accuracy requirement, as well as a scan-to-scan repeatability requirement necessary to address the "target stitching" phenomena to meet overall system accuracy requirements. Furthermore, a tethered aerostat experiences translational motion in turbulent conditions which can approach 100 feet per second. Doppler based sensors, such as radar, must also be compensated for this aerostat motion along the sensor line of sight. Previous inertial navigation systems can not provide translational velocity measurements to the required accuracy of 0.5 feet per second or better, over extended mission times of aerostats, without periodic position updating.

In light of the foregoing, there is a need for reliable motion measurement of an airborne platform that is capable of both long term and short term measurement accuracy, which can provide scan to scan azimuth angle repeatability, which can provide line of sight sensor velocity, and is able to provide an accurate geographically stabilized sensor bearing measurement continuously without regard to atmospheric conditions; and still can be fabricated of components of medium precision and lower cost, as compared to high precision costly components.

SUMMARY OF INVENTION

Accordingly, the present invention is directed to a motion measurement system and method that substantially obviates one or more of the limitations and disadvantages of the prior art.

Additional advantages of the invention will be set forth in the description which follows, and in part will be apparent from the descriptions or may be learned by practice of the invention. The specific objectives and other advantages of the invention will be realized and attained by the system and method particularly pointed out in the written description and claims hereof as well as the appended drawings.

To achieve these and other objects and advantages and in accordance with the purpose of the invention, as embodied and broadly described herein, a motion measurement system for an airborne platform having an antenna for radiating a rotating beam includes at least one rate sensor mounted in a fixed position relative to the rotating beam for generating signals corresponding to the rate of rotation of the beam; and means for receiving a signal corresponding to an alignment error of the rotating beam; means for generating a signal corresponding to a geographic azimuth bearing angle of the antenna beam in accordance with the rate of rotation signal and the alignment error signal.

In another aspect, the motion measurement system has an antenna for radiating a rotating beam including a plurality of rate sensors mounted in fixed relation to the rotating beam for generating signals corresponding to the angular rate of the scanning of the beam; a plurality of accelerometers fixed relative to the rotating beam for generating signals corresponding to the linear acceleration of the antenna; means for receiving an external velocity signal corresponding to the velocity of the antenna along the antenna beam; means responsive to the linear acceleration signals from the plurality of accelerometers and the external velocity signal and the angular rate signals for generating signals corresponding to the velocity of the antenna along the antenna beam; means responsive to the external velocity signal for generating a signal corresponding to an initial velocity of the antenna; and means for providing a continuous velocity measurement of the antenna in accordance with the initial velocity signal, the angular rate signals, and the linear acceleration signals.

DESCRIPTION OF THE PREFERRED EMBODIMENT

Figure 1:
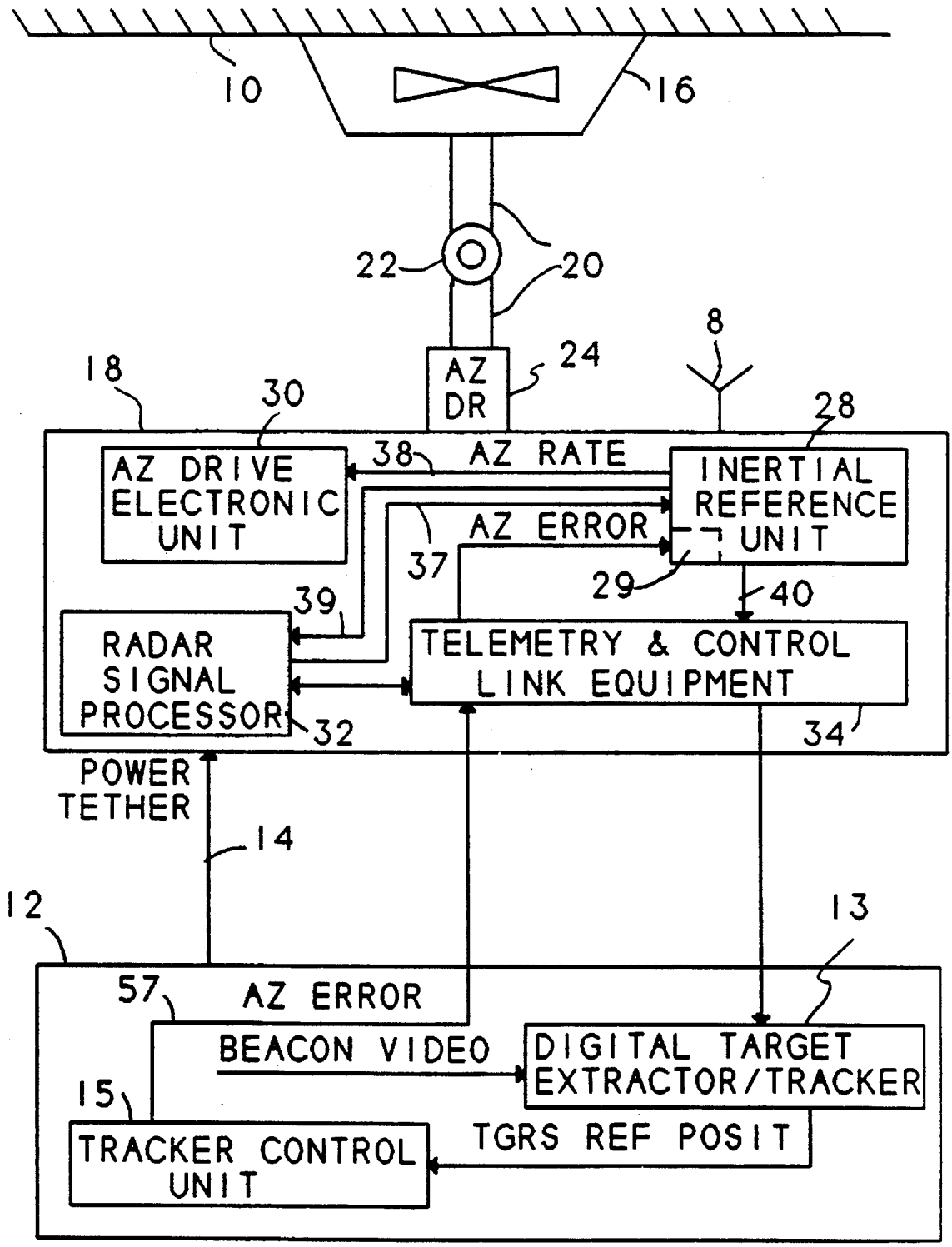
FIG. 1 is a schematic block diagram of an aerostat mounted system according to a preferred embodiment of the present invention.

The present invention comprises a motion measurement system for an airborne platform. As herein embodied and referring to FIG. 1, an aerostat which may be a conventional type of lighter than air craft such as a balloon, for example, is referred to at 10. Aerostat 10 is tethered to a ground station 12 by a power tether 14. Aerostat 10 has a payload truss portion 16 to which a schematically illustrated payload platform 18 is pendulously suspended by frame members 20 through a two degree of freedom gimbal 22 so that platform 18 will remain substantially level during rolling and pitching of the aerostat 10. An azimuth drive 24 rotates the payload platform 18, for scanning a mounted radar antenna in azimuth (not shown) at a fixed angular rate relative to the ground independent of aerostat yaw.

The motion measurement system and method of the present invention comprises at least one rate sensor mounted in a fixed position relative to the rotating beam for generating signals corresponding to the rate of rotation of the radiated beam. The system and method may also include a plurality of accelerometers fixed relative to the rotating beam for generating signals corresponding to the linear acceleration of the antenna.

Figure 2:
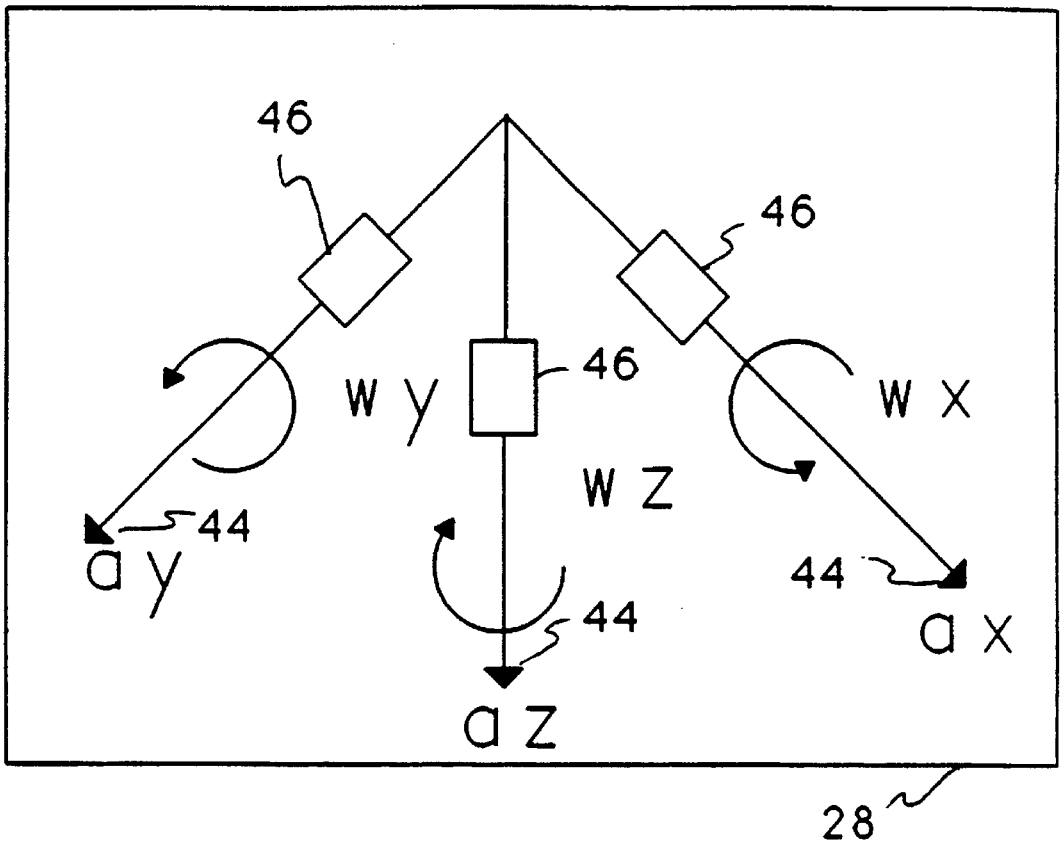
FIG. 2 is a schematic diagram illustrating the operative arrangement of six degree-of-freedom accelerometers and rate sensors of the inertial reference unit of the system of FIG. 1.

As herein embodied and referring to FIGS. 1 and 2, fixedly mounted to the suspended payload platform 18 is an inertial reference unit (IRU) 28, with a single board computer portion 29 and six degree of freedom instruments that include three rate sensors 46 and three accelerometers 44. Also mounted on the platform 18 is an azimuth drive electronic unit 30, a radar signal processing unit 32, and telemetry and control link equipment 34.

The three accelerometers 44 and three rate sensors 46 are cluster mounted in a fixed relationship to the radar antenna such that they measure motion in orthogonal directions. The accelerometers 44 measure the three translational components of motion while the rate sensors 46 measure the three angular components. In FIG. 2 ax=forward acceleration, ay=right acceleration, az=down acceleration, $W_x$=roll rate, $W_y$=pitch rate, and $W_z$=yaw rate. The mounted fixed relationship to the radar antenna is such that x (forward) $\underline{\Delta}$ along the antenna beam, Y (right) $\underline{\Delta}$ right, across the antenna beam, and z (down) $\underline{\Delta}$ down, through the antenna beam.

Quartz rate sensors 46 measure angular rates $W_x$, $W_y$, and $W_z$ above and are functionally equivalent to traditional rate gyros. However they operate on very different physical principles; the characteristics of a vibrating (quartz) tuning fork versus those of a spinning momentum wheel. Thus, they are essentially "solid-state" devices with small size, long life, and low-power consumption relative to typical mechanical gyros. The quality of quartz rate sensor measurement outputs is similar to typical rate gyros, which is inadequate for traditional navigation purposes, but more than adequate for traditional autopilot feedback or servo stabilization purposes. So it is not measurement precision that motivates quartz rate sensor usage in the IRU 28 and, in fact, many alternative gyros may be used for applications where performance is the only criteria. They were selected for their small size, long life, and relatively low power consumption. One of the advantages of the system and method of the present invention is that it is configured to permit instruments of medium measurement quality, like the quartz rate sensor to be used in this application. Prior mechanizations typically require instruments of much higher quality, like ring-laser-gyros, for example.

The accelerometers 44 measure the accelerations ax, ay, and az above. They are of the common force-rebalance style. That is, they contain a pendulously-suspended mass and feedback servo loop. The mass which tends to displace under acceleration conditions, has its displacement nulled by closed loop action with the resulting restoring torque of the servo becoming a measure of the input acceleration. As with the quartz rate sensors, an advantage of the system and method of the present invention permits these accelerometers, which are of medium measurement precision to be used.

In accordance with the invention, the system and method includes means for receiving a signal corresponding to an alignment azimuth error of the rotating beam and/or means for receiving an external velocity signal corresponding to the velocity of the antenna along the antenna beam.

Ground station 12 includes a digital target extractor and tracker module 13 and a tracker control unit (TCU) 15. The inertial reference unit 28 supplies an azimuth scan rate signal on line 38 to the azimuth drive electronics unit 30 for antenna speed control, it supplies an azimuth bearing angle signal on line 40 to the digital target extractor 13 via telemetry link equipment 34 for target location, and it supplies the along-beam velocity signal on line 39 to the radar signal processor 32 for initialization of the radar's ground clutter tracker. These signals are computed within the inertial reference unit 28 by its single board computer 29 based on internal six-degree-of-freedom instrument measurements and external alignment/initialization measurements.

External measurements supplied to IRU 28 provide long-term accuracy for its output signals. Although a system such as Loran C or GPS may be used to obtain the geographic location of the aerostat, long-term antenna azimuth accuracy is supplied preferably by the azimuth error signal on line 57 for the bearing angle signal 40 from a true ground reference system referred to as TGRS. For the along-beam velocity signal from the IRU 28 on line 39, long-term accuracy is preferably supplied from the clutter tracker doppler signal on line 37.

Figure 3:
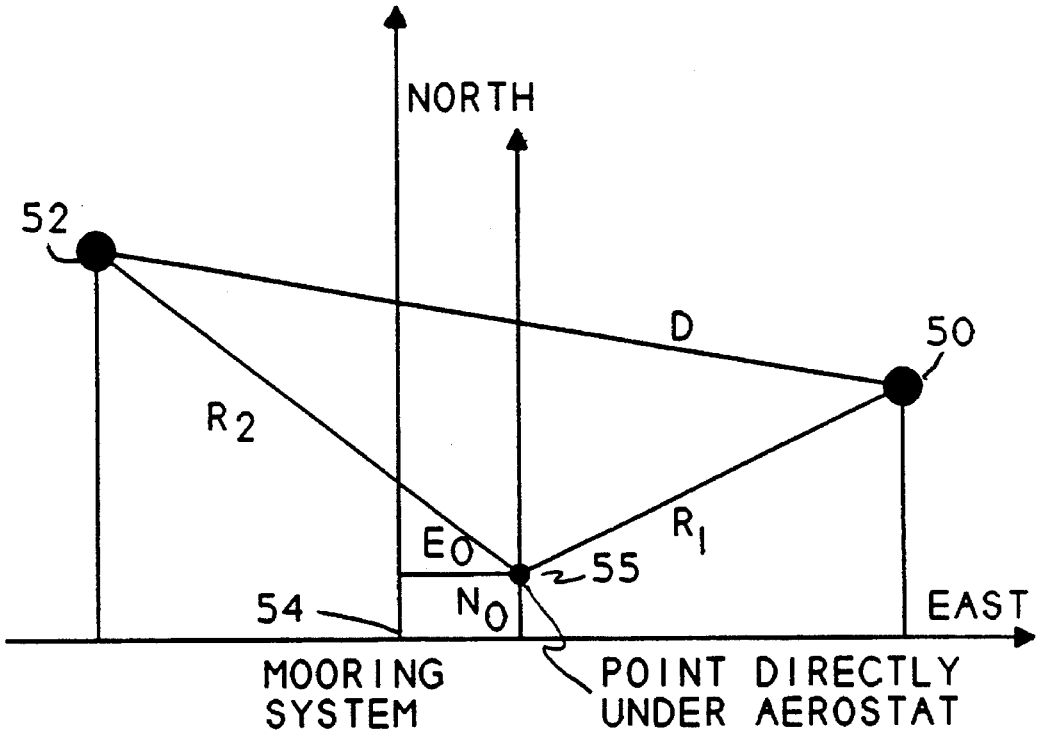
FIG. 3 is an aerial view illustrating the geometry and of a true ground reference system (TGRS) used in the system of FIG. 1.

Referring to FIG. 3, the details of which form part of the present invention, as the platform 18 rotates at approximately five RPM, for example, the antenna beam scans the coverage area including each transponder 50 and 52 every twelve seconds. As the antenna beam passes transponder 50, it is interrogated by the beam and responds in a well known manner for measuring the position of the transponder 50 with respect to the antenna. Approximately three seconds later the beam scans transponder 52 where the position of the transponder 52 is measured with respect to the beam.

The inertial reference unit 28 provides the azimuth rate measurement on line 38 in the form of azimuth change pulses (ACP's) to the azimuth drive electronics unit 30 where, uncorrected they are used as a servo feedback signal to regulate the excitation applied to the azimuth drive motor 24, thereby achieving the desired rotation or scanning rate of the antenna. These pulses occur whenever a fixed angular increment has accrued, and so the elapsed time between azimuth change pulses is a measure of rotation rate.

Geographical azimuth bearing angle measurement on line 40 is also produced by the IRU 28, which may be in the form of azimuth change pulses (ACP's) and azimuth reference pulses (ARP's). Each azimuth change pulse is output, for example, upon accrual of $1/4096$ part of a revolution of the platform. The ARP's occur once every antenna revolution as the antenna beam passes North. A fixed number of 4096 ACP's is therefore generated between ARP's.

Figure 4:
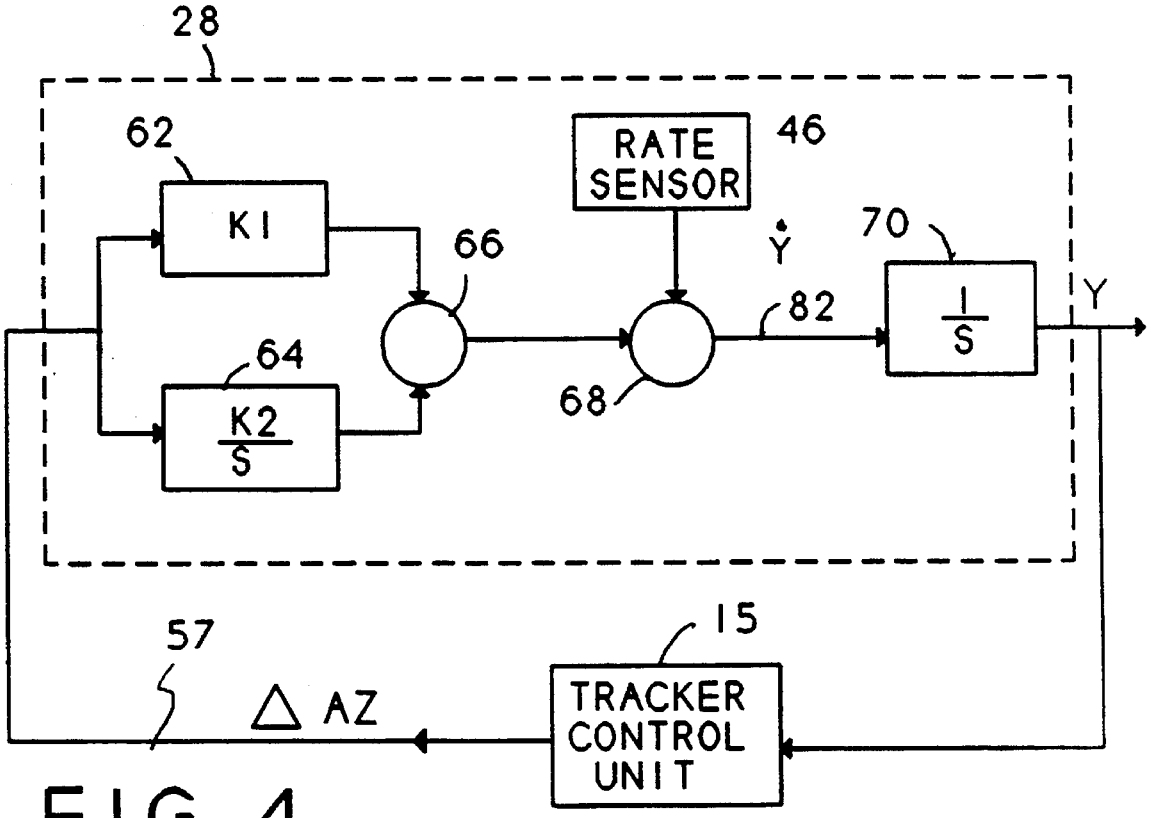
FIG. 4 is a schematic block diagram of the azimuth calculation portion including the azimuth correction loop of the inertial reference unit of FIG. 1.
Figure 5:
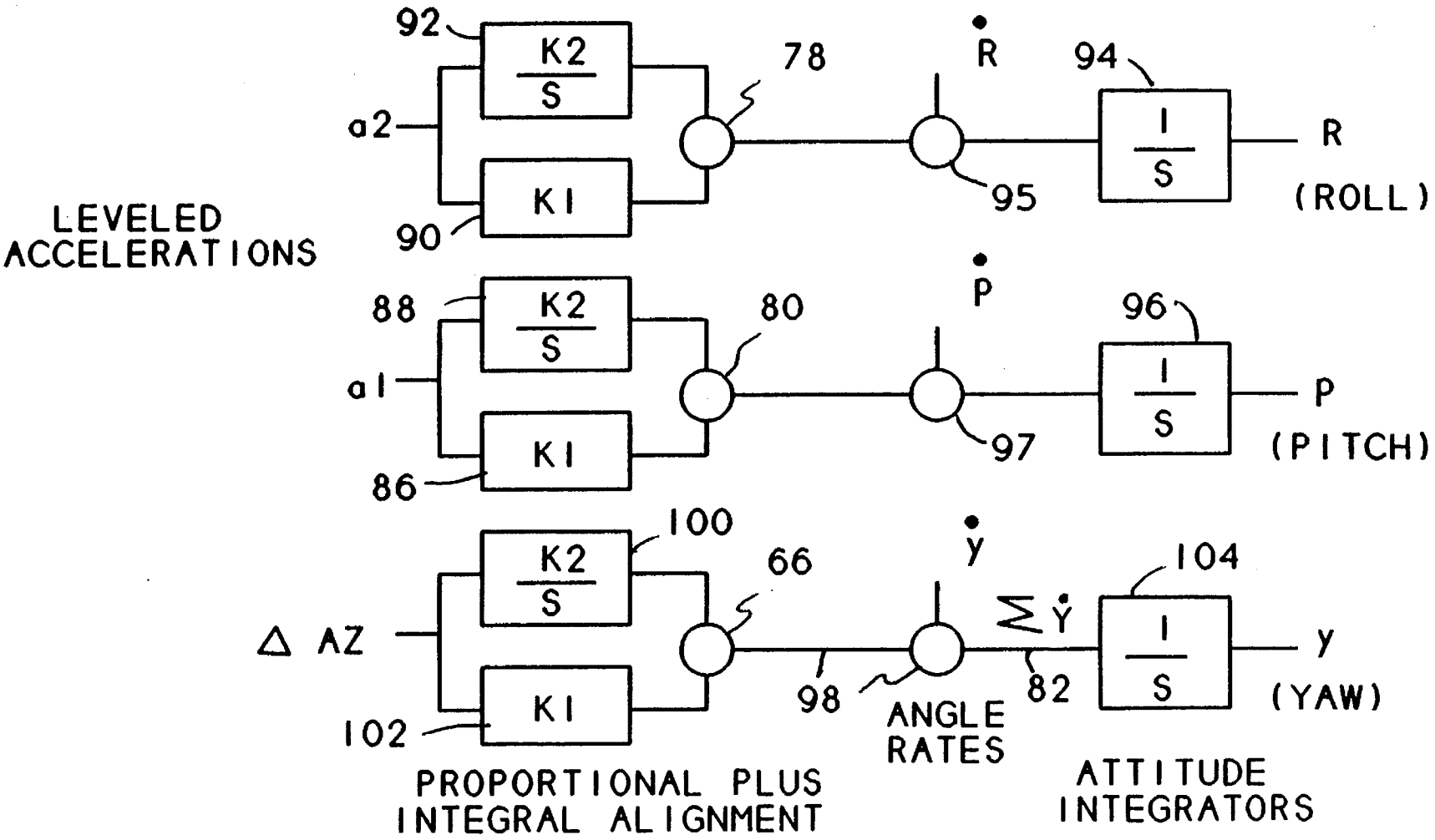
FIG. 5 is a schematic functional diagram of attitude integrator processing within the inertial reference unit of FIG. 1.

The position of the aerostat with respect to the mooring system is compared by TGRS using beacon range measurements R1 and R2, obtained each time the antenna rotates past the transponder positions 50 and 52. The original offset referred to at point 55 in FIG. 3 is determined by geometric computations so that all target reports are referenced to the mooring system 54 instead of the aerostat 10. This offset 55 from point 54 which is calculated by TGRS algorithms of the tracker control unit 15 is then used to determine azimuth truth of transponders 50 and 52. The reported bearing measurement to each transponders 50 and 52 is then compared as truth to obtain an azimuth error value which is transmitted over line 57 via the telemetry link 34 for transfer to the IRU 28. The offset and azimuth errors are updated twice during each complete scan, once when the radar beam passes transponder 50 and again when it passes 52. Referring to FIGS. 4 and 5, this azimuth error is shown as ΔAz. IRU 28 continually corrects its azimuth bearing angle output, shown as Y in FIGS. 4 and 5, by driving ΔAz to zero, thereby achieving long-term accuracy. ΔAz processing is shown to be proportional-plus-integral calculations with multiplicative constants K1 and K2 respectively to produce the required correction rates 82 of FIG. 4.

Referring to FIG. 4, the azimuth error from the Tracker Control Unit 15 at the ground station 12 is transmitted over line 57 to the IRU 28 where it is subjected to constants K1 and K2 at blocks 62 and 64 respectively. The K1 is proportional; while K2 is integral; and the results are summed at 66 to produce correction rates which are further summed at 68 with the transformed output of rate sensor 46. The constants K1 and K2 are selected to satisfy stability constraints and attenuate (filter) random noise components of the ΔAZ signal injected by the described TGRS processing at the ground station. The azimuth pointing angle is formed from the summed rate 82 by integrating in real time at block 70 to provide a geographically corrected angular azimuth position corresponding to the instantaneous azimuth angle of the radar beam. This is converted to ACP's and a corrected azimuth reference pulse ARP, and transmitted back to the ground station Tracker Control Unit 15 to calculate the offset position 55, and azimuth error and transmitted over line 57 for processing at the unit 28 as previously described. Thus, the angular azimuth postion is continuously compared to the true ground reference determined by the TGRS, and any difference ΔAZ is transmitted-to the inertial reference unit 28. This continuous corrective action during each scan compensates for the imperfections of the quartz rate sensors, and drives the ΔAZ to zero.

The IRU 28 and rate sensors 46 are mounted directly on the payload platform and sense space rate (W) which is integrated into the antenna pointing angle. The antenna pointing angle is sent to the ground station and is used in the digital target extraction process of 13 for azimuth location of radar targets. The errors in position are measured for each transponder 50, 52 on every scan and sent back for closed loop correction. The loop as previously resummed is a proportional/integral type and has a very slow time constant as compared to the rate sensor measurement itself. The system then aligns to true north, retains that under slow variations, e.g. temperature effects, in the rate sensor scale factor and bias errors.

In accordance with the invention, means responsive to the external velocity signal are provided for generating a signal corresponding to an initial velocity of the antenna; and means are included for providing a continuous velocity measurement of the antenna along the beam in accordance with the initial velocity signal and the linear acceleration signals.

Figure 6:
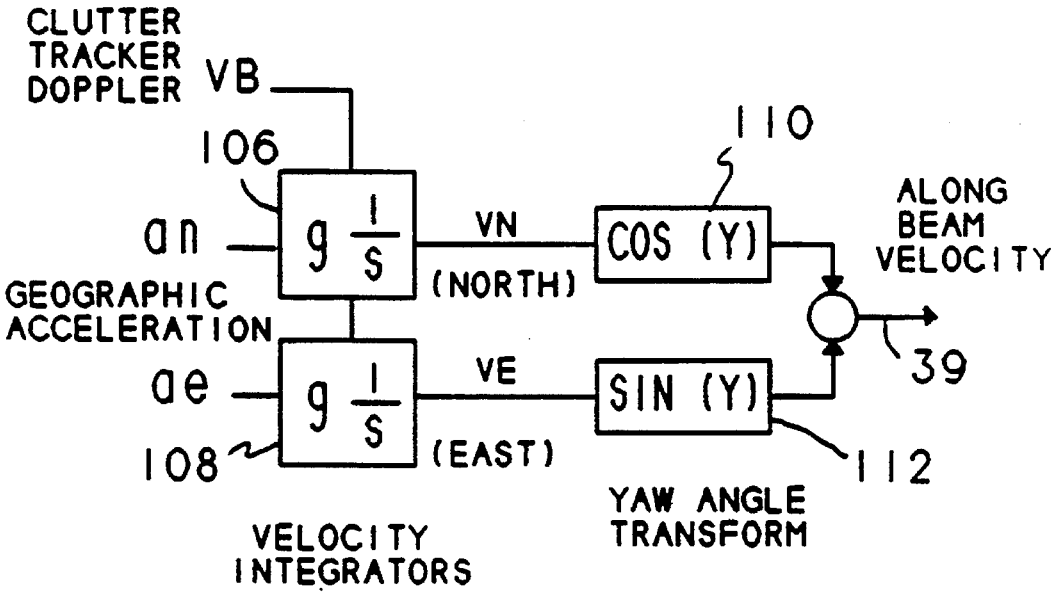
FIG. 6 is a schematic functional diagram of the velocity integrator processing within the inertial reference unit FIG. 1.

As herein embodied and again referring to FIG. 1, along beam velocity signal on line 39 is reinitialized based on the value of the clutter tracker doppler signal 37 to achieve its long-term accuracy. Referring to FIG. 6, this doppler signal is shown as VB, whose value is used to initialize the values of the velocity integrators 106 and 108 within IRU 28. This initialization occurs at the end of a period when the radar system has been actively tracking clutter. When clutter tracking ceases, for example, these integrators are not continually aligned as described for the attitude (Y, P, R) integrators of FIG. 5. Instead, they are repetitively reset, or re-initialized, to velocity measurements made by the radar system's ground-clutter tracker when that device is active as indicated by input VB from the clutter tracker Doppler. When clutter returns are low because of an over-water scan, integrators 106 and 108 begin continually processing accelerations ∂n and ∂e to produce geographical velocities VN and VE. These are then transformed to beam coordinates at 110 and 112 to produce the along-beam velocity measurement 39. The transformations using cosine of Y at 110 and the sine of Y at 112 use the current azimuth bearing angle Y also shown in FIGS. 4 and 5. When clutter tracking begins again, such as when the radar next encounters strong clutter returns, the along-beam velocity measurement 39 is used by the clutter tracker of radar signal processor 32 as an initial velocity set point for its clutter tracker doppler value.

In accordance with the invention, the system and method include means for generating a signal corresponding to a geographic azimuth bearing of the antenna in accordance with the rate of rotation signal and the azimuth error signal, and means for generating signals corresponding to the velocity of the antenna along the antenna beam in accordance with the acceleration signals and the external velocity signals and the angular rate signals.

Figure 7:
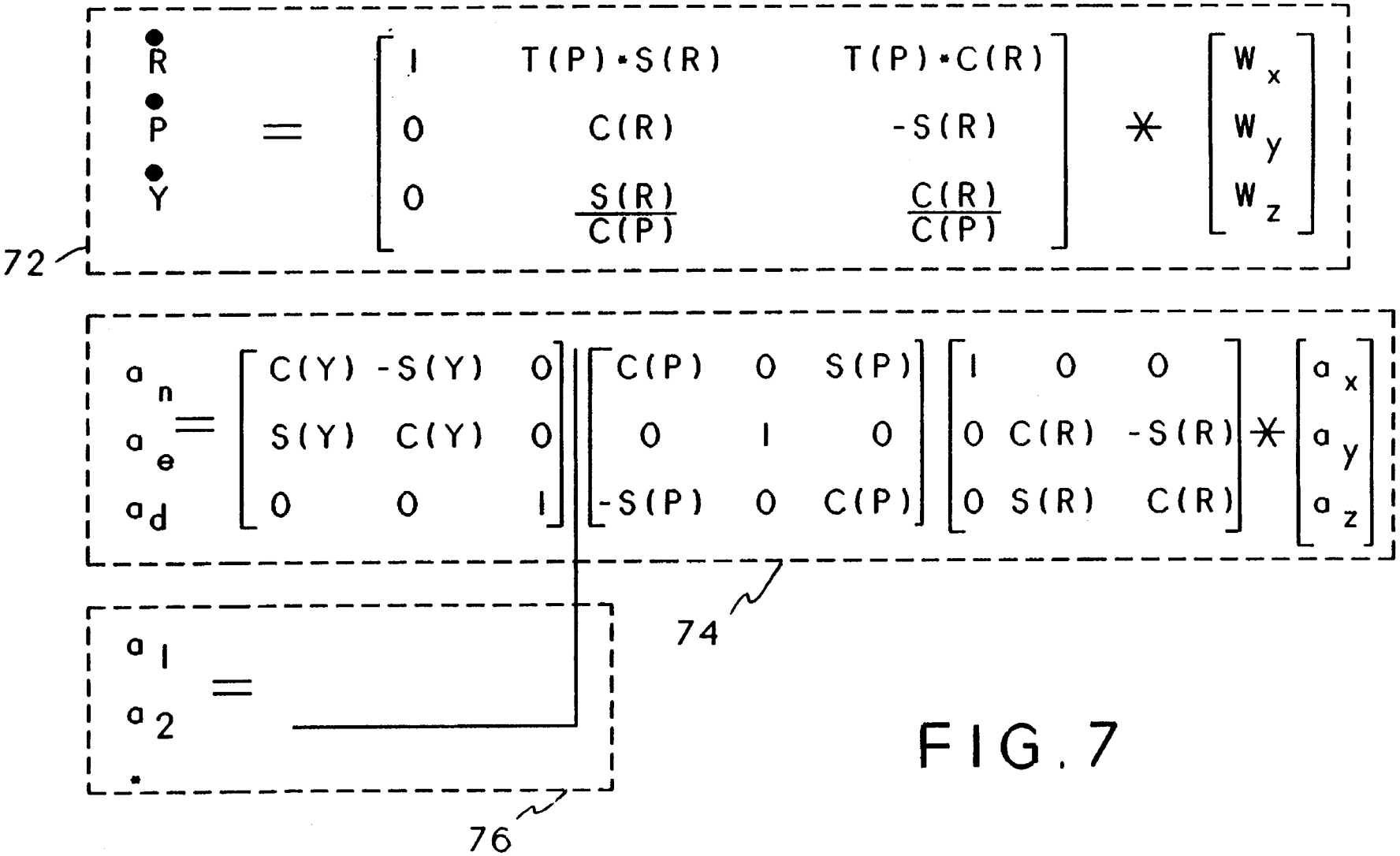
FIG. 7 is a diagram illustrating the six degrees of freedom processing within the inertial reference unit of FIG. 2.

As herein embodied and again referring to FIGS. 4, 5, 6, and 7 which show the transformation of the internal six-degree-of-freedom measurements, which are then real-time integrated by the single board computer 29. The high repetition rate of these calculations, approximately 200 hertz, provides the IRU output signals 38, 39, and 40 with short term dynamic accuracy. The details of the mathematical transformations concerned with the six degrees of freedom measurement processing are shown in FIG. 7. The sensed rate of the quartz rate sensors 46 must be transformed to a mathematically correct form before real time integration can occur. The transformation process for gyros $W_x$, $W_y$, and $W_z$ is within dashed lines 72 where:

T(·)=tangent

S(·)=sine

C(·)=cosine

R=roll angle

P=pitch angle

Y=yaw angle,

Thus, the yaw angle rate $\dot{Y}$ of FIG. 4, is integrated to produce Y, the azimuth bearing angle. Also the real-time roll angle (R), and pitch angle (P) integrations are performed using the $\dot{R}$ and $\dot{P}$ rates resulting from this transformation shown in FIG. 5.

Referring again to FIG. 7 similar transformations based on the angles Y, P, and R are also performed on accelerometer measurements to obtain geographical north and east accelerations suitable for processing by the velocity integrators of unit 28. These transformations which are shown within dashed lines 74 of FIG. 7 use the outputs ax, ay, and az of the accelerometers 44 to obtain the geographically acceleration of the platform in the north and east directions, which are referred to as $a_n$ and $a_e$ respectively. These geographical accelerations are used for velocity integrators as hereinafter described. It is noted that all transformations use the attitude integration angles R, P, and Y.

The portion of the diagram of FIG. 7 within dashed lines 76 shows the transformation of $a_x$, $a_y$, and $a_z$ which result in leveled acceleration components at an intermediate stage of the acceleration transformation. These accelerations $a_1$ and $a_2$ serve as alignment references for the pitch (P) and roll (R) calculations, thus, performing a function similar to the ΔAz signal in the Y channel for the azimuth calculation. Here the inertial reference unit 28 uses the accelerometer signals $a_x$ and $a_y$, as levels, that is, as measures of pitch and roll tilt toward the earth's gravity vector.

Referring to the attitude integrator processing of FIG. 5, the rates of roll R, pitch P, from FIG. 7 are input to summers 95, and 97, respectively, and the leveled accelerations $a_1$ and $a_2$ for pitch and roll alignment are subjected to proportional-plus-integral processing with the constants $K_1$ and $K_2$ at blocks 86 and 88 and blocks 90 and 92. The resulting correction rates at 78 and 80 are summed with the angular rates R and P. These results are then subjected to attitude integration at block 94 and 96 to obtain the attitude angles for roll and pitch of the platform 18. The rate of yaw $\dot{Y}$ obtained from FIG. 7 is summed at 98 with the yaw correction rate from 82. The angle rate $\Sigma\dot{Y}$ is integrated at 104 to produce the yaw angle Y.

The pendulum suspension of the present invention makes true lateral acceleration practically unobservable with the pitch and roll attitude calculations being required for restoration. The pitch and roll alignment of the present system and method removes acceleration bias/tilt error from the velocity output, permitting the use of inexpensive accelerometers. The K1 and K2 constants of 86, 88, 90, and 92 in FIG. 5 are set at values which permit accurate velocity integration for time periods up to the longest expected for periods of low clutter returns.

The configuration of the motion measurement system provides improvements in performance, simplicity, and reliability, and yet consists of very economical components. The system and method described has been able to eliminate a magnetic flux compass, short term angular referencing using a directional gyro slaved to a compass, antenna gimbal angle measurement using a synchro differential system driven by a directional gyro, and a linear motion sensor using a single axis accelerometers.

The above are replaced by a single compact inertial reference unit completely contained within the platform, which operates completely in an inertial and geographical reference frame; and thus, requires no information relative to aerostat heading, attitude angles, or relative payload to aerostat orientation and rotation.

It will be apparent to those skilled in the art, that various modifications and variations can be made in the system and method of the present invention without departing from the spirit or scope of the invention. Thus, it is intended that the present invention cover the modifications and variations of this invention provided they come within the scope of the appended claims and their equivalents.

What is claimed is:

1. A motion measurement system for an airborne platform tethered to a ground station, and an antenna mounted on the airborne platform for radiating a rotating beam and collecting return energy from the radiated beam, said system comprising:

at least one rate sensor mounted on the airborne platform in a fixed position relative to the rotating beam for generating signals corresponding to the rate of rotation of the radiated beam;

means positioned on a ground based platform responsive to a geographic azimuth bearing angle signal for generating azimuth alignment error signals means for receiving on the airborne platform the azimuth alignment error signals corresponding to an azimuth alignment error of the rotating beam; and means for processing the rate of rotation signals and the azimuth alignment error signals to generate the bearing angle signal corresponding to a geographic azimuth bearing of the beam.

2. A method of measuring the motion of an airborne platform tethered to a ground station having an antenna mounted on the airborne platform for radiating a rotating beam and collecting return energy from the radiated beam, the method comprising, sensing the rate of rotation of the antenna beam;

generating signals corresponding to the rate of rotation of the antenna beam;

generating azimuth alignment error signals on a ground based platform in response to a geographic bearing angle signal;

receiving signals corresponding to an azimuth alignment error of the rotating beam; and generating a signal corresponding to a geographic azimuth bearing of the antenna in accordance with the rate of rotation signals and the alignment error signal.

3. A motion measurement system for an airborne platform having an antenna for radiating a rotating beam, said system comprising:

a plurality of rate sensors mounted in fixed relation to the rotating beam for generating signals corresponding to the angular rate of the scanning of the beam;

a plurality of accelerometers fixed relative to the rotating beam for generating signals corresponding to the linear acceleration of the antenna;

means for receiving an external velocity signal corresponding to the velocity of the antenna along the antenna beam;

means responsive to the linear acceleration signals from the plurality of accelerometers and the external velocity signal and the angular rate signals for generating signals corresponding to the velocity of the antenna along the antenna beam;

means responsive to the external velocity signal for generating a signal corresponding to an initial velocity of the antenna; and means for providing a continuous velocity measurement of the antenna in accordance with the initial velocity signal, the angular rate signals, and the linear acceleration signals.

4. The system of claim 3 wherein the:

plurality of accelerometers are mounted in a fixed position relative to the antenna beam for generating signals corresponding to acceleration of the antenna in three orthogonal directions;

means governed by the acceleration signals for generating measurements corresponding to pitch and roll of the antenna; and means for generating a signal corresponding to the velocity along the beam of the antenna in accordance with the generated measurements.

5. The system of claim 4 wherein each of the accelerometers comprises a pendulously-suspended mass and a feedback servo loop, the suspended mass being displaced under acceleration conditions, means for nulling the displacement by closed loop action, closed loop action causing a restoring torque as a measure of input acceleration.

6. The system of claim 3 wherein the plurality of rate sensors comprise quartz rate sensors.

7. The system of claim 3 wherein the plurality of accelerometers comprise accelerometers of the force-rebalance style.

8. A method of measuring the motion of an airborne platform having an antenna for radiating a rotating beam, said method comprising:

generating signals corresponding to the angular rate of the scanning of the beam;

generating signals corresponding to the linear acceleration of the antenna;

receiving an external velocity signal corresponding to the velocity of the antenna along the antenna beam;

generating signals corresponding to the velocity of the antenna along the antenna beam in accordance with the linear acceleration signals and the external velocity signal and the angular rate signals;

generating a signal corresponding to an initial velocity of the antenna in accordance with the external velocity signal; and providing a continuous velocity measurement of the antenna in accordance with the initial velocity signal, the angular rate signals, and the linear acceleration signals.

9. A motion measurement system for an airborne platform having an antenna for radiating a rotating beam and collecting return energy from the radiated beam, said system comprising:

at least one rate sensor mounted in a fixed position relative to the rotating beam for generating signals corresponding to the rate of rotation of the radiated beam;

at least one accelerometer fixed relative to the rotating beam for generating signals corresponding to the linear acceleration of the antenna;

means for generating signals corresponding to the velocity of the antenna along the antenna beam in accordance with the acceleration signals and the angular rate signals;

means for receiving signals corresponding to an azimuth alignment error of the rotating beam; and means for processing the rate of rotation signals and the azimuth alignment error signal to generate a signal corresponding to a geographic azimuth bearing of the beam.

10. A method of measuring the motion of an airborne platform having an antenna for radiating a rotating beam, the method comprising:

sensing the rate of rotation of the antenna beam;

generating signals corresponding to the angular rate of rotation of the antenna beam;

receiving signals corresponding to an azimuth alignment error of the rotating beam;

generating a signal corresponding to a geographic azimuth bearing of the antenna in accordance with the angular rate of rotation signals and the azimuth alignment error signal;

generating signals corresponding to the linear acceleration of the antenna; and generating signals corresponding to the velocity of the antenna along the antenna beam in accordance with the acceleration signals and the angular rate signals.

* * * * *